US008742937B2

(12) United States Patent
Asano

(10) Patent No.: US 8,742,937 B2
(45) Date of Patent: Jun. 3, 2014

(54) ALARM UNIT

(75) Inventor: Isao Asano, Zama (JP)

(73) Assignee: Hochiki Corporation, Tokyo (JP)

( * ) Notice: Subject to any disclaimer, the term of this patent is extended or adjusted under 35 U.S.C. 154(b) by 665 days.

(21) Appl. No.: 12/664,476

(22) PCT Filed: Jul. 9, 2008

(86) PCT No.: PCT/JP2008/062424
§ 371 (c)(1),
(2), (4) Date: Dec. 14, 2009

(87) PCT Pub. No.: WO2009/011267
PCT Pub. Date: Jan. 22, 2009

(65) Prior Publication Data

US 2010/0188235 A1 Jul. 29, 2010

(30) Foreign Application Priority Data

Jul. 19, 2007 (JP) ..... 2007-188055

(51) Int. Cl.
*G08B 17/12* (2006.01)

(52) U.S. Cl.
USPC ..... 340/578; 340/577; 340/693.6

(58) Field of Classification Search
USPC ..... 340/500, 540, 577, 578, 693.6, 340/628–630
See application file for complete search history.

(56) References Cited

U.S. PATENT DOCUMENTS 4,491,830 A * 1/1985 Miyabe ..... 340/584
5,023,470 A * 6/1991 Onozuka et al. ..... 307/108

(Continued)

FOREIGN PATENT DOCUMENTS

JP 60-93450 6/1985
JP 03-022197 1/1991

(Continued)

OTHER PUBLICATIONS

Japanese Patent Office; Search Report and Written Opinion in International Patent Application No. PCT/JP2008/062424 dated Oct. 14, 2008.

(Continued)

*Primary Examiner* — James Yang
(74) *Attorney, Agent, or Firm* — Wood, Herron & Evans, LLP

(57) ABSTRACT

An alarm unit of the invention is provided with: a light emitting section; a battery power supply; a voltage booster circuit that boosts a voltage from this battery power supply to thereby generate a boosted voltage; a light emission control section that controls the voltage booster circuit to supply, with the timing at which the boosted voltage is obtained, the boosted voltage to the light emitting section, thereby intermittently driving light emission; a light receiving section that receives light from the light emitting section having been diffused by smoke; a conversion circuit that converts a received light signal from the light receiving section into received light data; a fire hazard detection section that detects a fire hazard based on the received light data from the conversion circuit; an alarm section that outputs an alarm based on a fire hazard detection signal from the fire hazard detection section; a reference voltage circuit that generates a reference voltage for the voltage booster circuit and the conversion circuit; and a clock circuit that outputs a clock signal for operating the voltage booster circuit, the light emission control section, and the conversion circuit. Furthermore, in this alarm unit, a packaged integrated circuit is provided with: a processor circuit that realizes functions of the light emission control section and the fire hazard detection section by executing a program; the voltage booster circuit; the conversion circuit; the reference voltage circuit; the clock circuit; and a control circuit of the respective circuit sections.

5 Claims, 6 Drawing Sheets

(56) References Cited

U.S. PATENT DOCUMENTS

| | | | | |
|---|---|---|---|---|
| 6,288,647 | B1 | 9/2001 | Yamano | |
| 2009/0009346 | A1 * | 1/2009 | Hojmose et al. | 340/628 |

FOREIGN PATENT DOCUMENTS

| | | | |
|---|---|---|---|
| JP | H05-008696 | | 2/1993 |
| JP | 06-223283 | | 8/1994 |
| JP | 10-042549 | | 2/1998 |
| JP | 11-185180 | A | 7/1999 |
| JP | 2001-126165 | | 5/2001 |
| JP | 2004-005000 | A | 1/2004 |
| JP | 2006-268132 | A | 10/2006 |
| JP | 2006-350412 | | 12/2006 |
| JP | 2007-011828 | | 1/2007 |
| JP | 2007-179367 | | 7/2007 |

OTHER PUBLICATIONS

Taiwanese Patent Office, Notice of Allowance issued in Application No. 098103213, mailed Nov. 4, 2013, 4 pp.

* cited by examiner

PRIOR ART

ALARM UNIT

TECHNICAL FIELD

The present invention relates to an alarm unit that is installed in a house and that is battery driven to detect smoke caused by a fire and issue an alert.

Priority is claimed on Japanese Patent Application No. 2007-188055, the contents of which are incorporated herein by reference.

BACKGROUND ART

A conventional alarm unit (photoelectric smoke sensor), which is known as a home fire alarm unit, detects a fire when the smoke density in a room exceeds a predetermined value and causes an alarm display lamp to blink, and it is provided with an alarm function for notifying, with an audio alert, the occurrence of the fire to people in the surrounding area.

Such a home alarm unit operates on a lithium battery serving as a power supply, and once a battery has been set therein, it is guaranteed that, for example, seven years of fire monitoring is possible without battery replacement.

In such an alarm unit, the battery voltage is, for example, 3 volts, which is too low for a voltage for light emission driving an LED, and therefore the battery voltage is boosted with a voltage booster circuit to, for example, 6 volts, which is a twofold voltage of the input voltage, to thereby cause the LED to emit light. Thus, even with a light emission in a short period of time in the order of microseconds, a sufficient amount of light is emitted from the LED, and light diffused by smoke particles flowing into a smoke-detection room is obtained.

FIG. 5 is a block diagram showing a light emission driving circuit of the conventional alarm unit, along with an MPU. In the light emission driving circuit 100 shown in the diagram, a constant voltage circuit 104 is provided so as to be series with a battery 102, to thereby charge, at a constant voltage, a large-capacity capacitor 106. To the capacitor 106, there are connected, via a switching device 108 such as transistor and FET, a large capacity capacitor 110 and a resistor 111, and there is further connected a resistor 112 so as to be parallel with a serial circuit formed with the switching device 108 and the capacitor 110. With such a connection structure, a charge pump circuit is configured. To the secondary side of the capacitor 110, an LED 116 which is a light emitting device is connected via a switching device 114.

The battery 102, in a state where the switching devices 108 and 114 are OFF, charges, via the resistor 112, the capacitor 110 at a constant voltage. When, for example, a fire hazard detection cycle of every 10 seconds is reached, the MPU 118 turns the switching device 108 ON and serially connects the capacitor 110 to the capacitor 106 to thereby boost the voltage to a twofold voltage of the input voltage. At the same time, the MPU 118 turns the switching device 114 ON, and thereby applies the voltage boosted in the serial connection of the capacitors 106 and 110, to the LED 116, causing it to emit light.

Light from the LED 116 collides with smoke particles flowing into the smoke-detection room, and is diffused. This diffused light is received on a photodiode 120, which is a light receiving device, to be converted into an imperceptible light reception signal, and is amplified in a received light amplifying circuit 122 in synchronization with the light emission drive. Then, it is input to the MPU 118 and is further converted, through AD conversion, into received light data. If this received light data exceed a predetermined fire hazard level, then an alarm output circuit 124 is operated to output a fire hazard alarm.

FIG. 6 is a block diagram showing a light emission driving circuit of another alarm unit, along with an MPU. The light emission driving circuit 100 does not require a constant voltage circuit; and with a battery 102, a large capacity capacitor 126 is charged at a constant voltage. To the capacitor 126, there is serially connected, via a switching device 128, a small capacity capacitor 130, and there is further connected a backflow preventing diode 132 so as to be parallel with the serial circuit formed with the switching device 128 and the capacitor 130. Moreover, a switching device 134 is serially connected to the capacitor 130.

To the secondary side of the capacitor 130, there is connected, via a backflow preventing diode 136, a large capacity capacitor 138, and there is further connected, via a switching device 140 and a constant voltage circuit 142, an LED 116, which is a light emitting device.

The battery 102, in a state where the switching device 128 is OFF and the switching device 134 is ON, charges the small capacity capacitor 130 via the backflow preventing diode 132. After this, the MPU 118 repeats operations of turning ON the switching device 128, switching OFF the switching device 134, serially connecting the capacitor 130 to the capacitor 126, and charging, at a boosted voltage, the large capacity capacitor 138 via the backflow preventing diode 136. When a fire hazard cycle of every 10 seconds is reached, the switching device 140 is turned ON, and the boosted voltage is applied to the LED 116, causing it to emit light.

As described above, by repeatedly performing charging with the small capacity capacitor 130, the amount of a single charge transfer is suppressed, thereby reducing the capacity of the switching devices 128 and 134. Moreover, the constant voltage circuit 142 is only operated when light emission is performed.

[Patent Document 1] Japanese Unexamined Patent Application, First Publication No. 2007-011828

[Patent Document 2] Japanese Unexamined Patent Application, First Publication No. 2006-350412

[Patent Document 3] Japanese Unexamined Patent Application, First Publication No. 2007-179367

[Patent Document 4] Japanese Unexamined Utility Model Application, First Publication No. H05-008696

PROBLEMS TO BE SOLVED BY THE INVENTION

However, such a light emission driving circuit of the conventional home use alarm unit has following problems.

First, the light emission driving circuit 100 shown in FIG. 5 has a problem in that the constant voltage circuit 104 is required, and moreover, electric current consumption of the constant voltage circuit 104 reduces the battery life. Furthermore, there is a problem in that for the voltage boosting operation, there are required two switching devices that use a transistor for flowing a comparatively large electric current, and consequently the cost will increase.

Moreover, the light emission driving circuit 100 shown in FIG. 6 is such that the constant voltage circuit 142 does not constantly consume electric current and the capacity of the capacitor 130 to be used for voltage boosting is small, and therefore a small transistor can be employed as the switching devices 128 and 134 to be used for voltage boosting. However, there is a problem in that since voltage boost is performed in repetitive operations of the switching devices 128 and 134, ineffective base electric current flows through the transistors, and furthermore, since operating electric current for the MPU 118 also flows when voltage boost is performed, the life of the battery 102 is reduced. Furthermore, there is a problem in that the diode 136 is required for preventing backflow of the capacitor 130, and consequently the number of components and the cost will increase.

DISCLOSURE OF INVENTION

The present invention takes into consideration the above circumstances, with an object of providing an alarm unit capable of further reducing electric current consumption even where voltage boost light emission is required, thereby extending battery life, while being capable of reducing the number of components and the cost.

Means for Solving the Problem

The present invention employs the following measures in order to solve the above problems and achieve the related object.

That is to say, (1) an alarm unit of the present invention is provided with: a light emitting section; a battery power supply; a voltage booster circuit that boosts a voltage from this battery power supply to thereby generate a boosted voltage; a light emission control section that controls the voltage booster circuit to supply, with the timing at which the boosted voltage is obtained, the boosted voltage to the light emitting section, thereby intermittently driving light emission; a light receiving section that receives light from the light emitting section having been diffused by smoke; a conversion circuit that converts a received light signal from the light receiving section into received light data; a fire hazard detection section that detects a fire hazard based on the received light data from the conversion circuit; an alarm section that outputs an alarm based on a fire hazard detection signal from the fire hazard detection section; a reference voltage circuit that generates a reference voltage for the voltage booster circuit and the conversion circuit; and a clock circuit that outputs a clock signal for operating the voltage booster circuit, the light emission control section, and the conversion circuit, wherein a packaged integrated circuit is provided with: a processor circuit that realizes functions of the light emission control section and the fire hazard detection section by executing a program; the voltage booster circuit; the conversion circuit; the reference voltage circuit; the clock circuit; and a control circuit of the respective circuit sections.

(2) As the control circuit corresponding to the clock circuit, there may be provided: a clock generating circuit that outputs a low speed clock signal and a high speed clock signal; a switching device that selects between the low speed clock signal and the high speed clock signal; and a control section that selectively outputs the high speed clock signal to the switching device in a case where a test mode is set, and that selectively outputs the low speed clock signal to the switching device in a case where a non-test mode is set.

(3) As the control circuit corresponding to the processor circuit and the voltage booster circuit, there may be provided: a first switching section that turns ON or OFF the clock signal supplied from the clock circuit to the processor circuit; a second switching section that turns ON or OFF the clock signal supplied from the clock circuit section to the voltage booster circuit; a voltage boost setting timer that sets an operating time of the voltage booster circuit; a sleep setting timer that sets a sleep time of the processor circuit; a voltage boost control section that, in a state where the first switching section is turned OFF and supply of the clock signal to the processor circuit is stopped, turns ON the second switching section and supplies the clock signal to the voltage booster circuit to thereby operate it, and that activates the voltage boost setting timer and monitors the elapse of the voltage boost set time; a processor control section that, in a state where the second switching section is turned OFF and supply of the clock signal to the voltage booster circuit is stopped when the voltage boost set time set by the voltage boost setting timer has elapsed, turns ON the first switching section and supplies the clock signal to the processor circuit to thereby operate it; and a sleep control section that turns OFF the first switching section and stops supply of the clock signal when the operation of the processor circuit is finished, and that, at the same time, activates the sleep setting timer, monitors the elapse of the sleep set time, and shifts to a processing of the voltage boost control section when the sleep set time has elapsed.

(4) It may be arranged such that the control circuit has a control register provided with a first control bit and a second control bit corresponding to the first switching section and the second switching section, and turns ON or OFF the first switching section and the second switching section to thereby control supply and stop of the clock signal, according to a bit set and a bit reset with respect to the first control bit and the second control bit.

(5) The voltage booster may receive an input of the reference voltage output from the reference voltage circuit to thereby generate a substantially twofold boosted voltage.

Effect of the Invention

According to the alarm unit of the present invention, by providing in an integrated circuit; the processor circuit that realizes the functions of the light emission control section and the fire hazard detection section by executing a program, the voltage booster circuit, and the reference voltage circuit, external circuits for light emission driving with a boosted voltage can be kept to minimum. Therefore, according to the present invention, it is possible to reduce the number of components and the cost.

Moreover, by providing the voltage booster circuit in the integrated circuit, it is possible to use a circuit such as bipolar transistor that does not allow ineffective base electric current to flow therethrough, as a switching device to be used for voltage boosting operation. Therefore, according to the present invention, it is possible to reduce electric current consumption, thereby further extending battery life.

Moreover, clock supply of the processor circuit stops when the voltage booster circuit is operating, and clock supply of the voltage booster circuit stops when the processor circuit is operating. Furthermore, during a period of light-emission OFF time of a fire hazard detection cycle of for example, 10 seconds cycle, it is in a sleep state where clock supply to both of the processor circuit and the voltage booster circuit is stopped. By employing such a configuration, it is possible to significantly reduce electric current consumption in the integrated circuit, thereby extending battery life.

In particular, in the operation of the voltage booster circuit to be performed by stopping clock supply of the processor circuit, by boosting the voltage with use of the low speed clock, taking nearly 300 milliseconds for example, it is possible to boost the voltage with extremely small electric current consumption. Therefore, according to the present invention, as a whole integrated circuit, it is possible to significantly reduce electric current consumption, thereby extending battery life.

Moreover, the voltage booster circuit provided in the integrated circuit receives an input of a reference voltage from the reference voltage circuit that generates a reference voltage of an AD conversion circuit, which is also provided in the integrated circuit, to thereby boost voltage. Consequently, according to the present invention, it is possible to easily generate stable boosted voltage without need of a constant voltage circuit.

Furthermore, it is possible, with an external setting, to select the high speed clock in an inspection step of a manufacturing stage, and it is consequently possible to increase operating speed in the inspection step and the like, thereby reducing the amount of time required for inspection.

DESCRIPTION OF REFERENCE SYMBOLS

Figure 1:
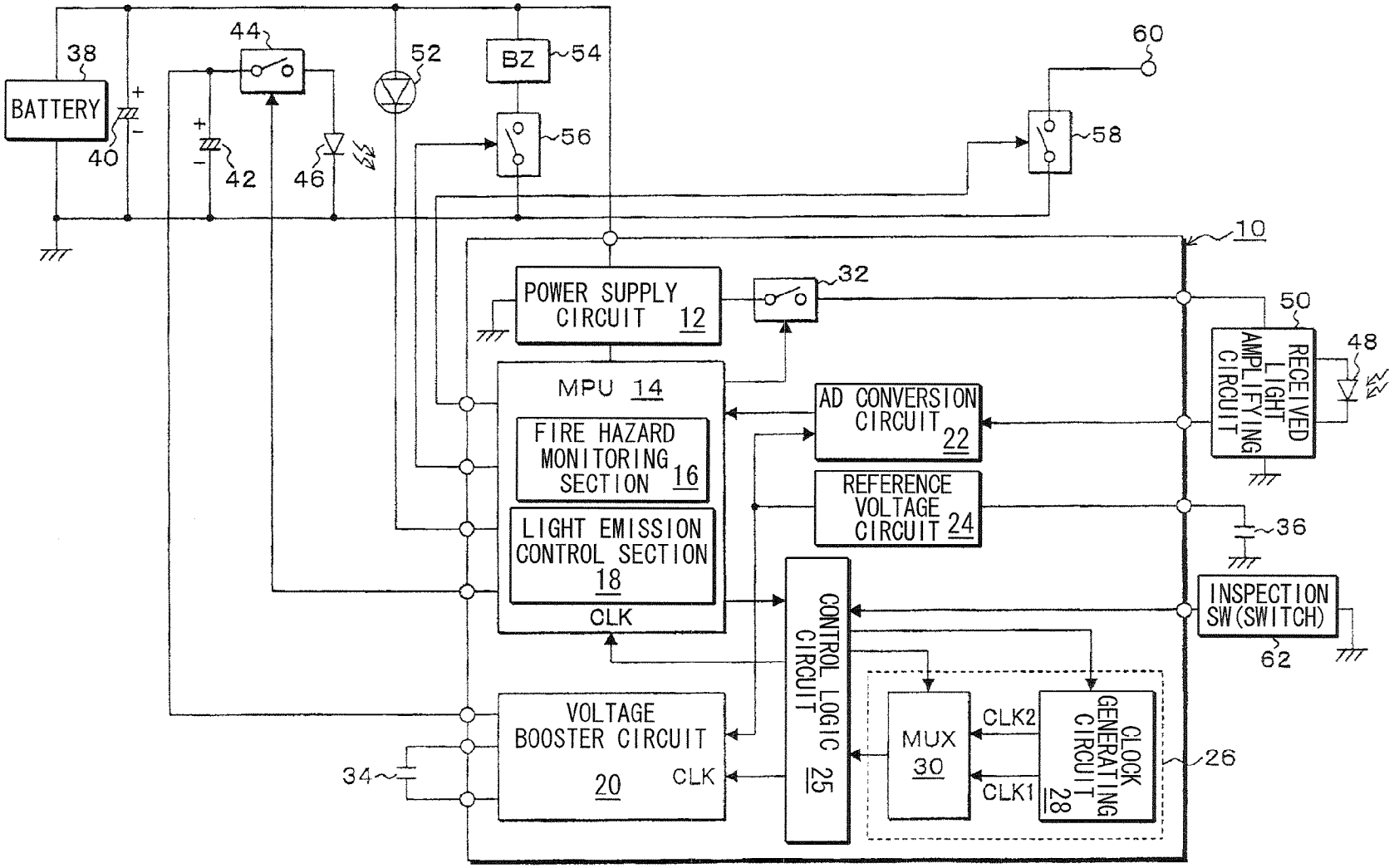
FIG. 1 is a circuit block diagram showing an embodiment of an alarm unit according to the present invention.

10 Integrated circuit
12 Power supply circuit
14 MPU
16 Fire hazard monitoring control section
18 Light emission control section
20 Voltage booster circuit
22 AD conversion circuit
24 Reference voltage circuit
25 Control logic circuit
26 Clock circuit
28 Clock generating circuit
30 Multiplexer (switching device. MUX)
32 Light reception synchronization switch
34, 36, 40 Capacitor
38 Battery (battery power supply)
40 Power supply capacitor
42 Boosted voltage retention capacitor
44 Light emission driving switch
46 LED
48 Photodiode
50 Received light amplifying circuit
52 Alarm display lamp
54 Buzzer
56 Buzzer driving switch
58 Signal transmission circuit
60 Signal transmission terminal
62 Inspection switch
64 Control register
66 MPU clock control bit
68 Voltage boost clock control bit
70 Clock selection bit
72 Voltage boost setting timer
74 Sleep setting timer
76 OR gate
78 Inverter
80, 82 AND gate

BEST MODE FOR CARRYING OUT THE INVENTION

FIG. 1 is a circuit block diagram showing an embodiment of a home-use alarm unit (photoelectric smoke sensor) according to the present invention. As shown in the same diagram, the alarm unit of the present embodiment is provided with an integrated circuit 10. To this integrated circuit 10, external circuits are connected.

In the integrated circuit 10, there are provided: a power supply circuit 12; an MPU 14 that functions as a processor circuit; a voltage booster circuit 20 that generates a boosted voltage for light emission driving; an AD conversion circuit 22; a reference voltage circuit 24; a control logic circuit 25; and a clock circuit 26.

In the clock circuit 26, there are provided: a clock generating circuit 28 that generates two types of clock signals, namely a low speed clock CLK1 and a high speed clock CLK2; and a multiplexer (a switching device. MUX) 30 that switches and outputs the low speed clock CLK1 and the high speed clock CLK2.

The MPU 14 is a so-called single chip computer. The bus of the MPU 14 is provided with a RAM, a ROM, and an interface, and realizes, as functions based on program execution, functions of a fire hazard monitoring section 16 and a light emission control section 18.

To the voltage booster circuit 20 provided in the integrated circuit 10, a capacitor 34 to be used for voltage boosting is externally connected. Moreover, to the reference voltage circuit 24, a capacitor 36 required for stabilizing a reference voltage is externally connected.

To the integrated circuit 10, a battery 38 to be used as a power supply is connected as an external circuit. As the battery 38, for example, a lithium battery or the like is used. Following the battery 38, a power supply capacitor 40 is connected.

In order to charge a boosted voltage output from the voltage booster circuit 20, a boosted voltage retention capacitor 42 is provided. Following this boosted voltage retention capacitor 42, a light emission driving switch 44 is provided. Furthermore, an LED 46 that forms a light emission section is provided so as to be in series with the light emission driving switch 44.

The light emission driving switch 44 is switched ON by the light emission control section 18 of the MPU 14 for a short period of time in the order of microseconds, for example, in a predetermined light emission cycle T0 (for example, T0=10 seconds interval), and supplies the boosted voltage of the boosted voltage retention capacitor 42 charged by the voltage booster circuit 20 to the LED 46, causing it to emit light.

Light emitted from the LED 46 collides with particles of smoke flowing into a smoke-detection section (not shown in the drawing), and creates diffused light. This diffused light is received on a photodiode 48 that forms a light receiving section of a received light amplifying circuit 50 externally connected to the integrated circuit 10 so as to become received light electric current, and is amplified by the received light amplifying circuit 50. A part of the received light amplifying circuit 50 may be built-in to the integrated circuit 10.

A received light signal from the received light amplifying circuit 50 is converted in the AD conversion circuit 22 of the integrated circuit 10 into received light data, to be read into the MPU 14. The received light amplifying circuit 50, with switching of the light reception synchronization switch 32 by the MPU 14, is driven in synchronization with light emission of the LED 46, and it amplifies the received light electric current.

The fire hazard monitoring control section provided in the MPU 14 compares the received light data read from the AD conversion circuit 22, with a predefined fire hazard level, and determines a fire hazard if the fire hazard level is exceeded. An alarm display lamp 52, which uses an LED, shown on the right side of the LED 46 in FIG. 1 is blinked or lit, while a buzzer driving switch 56 is turned ON and an audio alarm is issued by the sound of a buzzer 54.

The MPU 14, by turning ON a switching device of a signal transmission circuit 58, causes signal transmission electric current to flow in a case where another device is connected to a signal transmission terminal 60, to thereby output a signal transmission signal.

It is arranged such that an inspection switch 62 can be temporarily connected to the outside of integrated circuit in an inspection step of a manufacturing stage thereof. The inspection switch 62 is connected to the control logic circuit 25 of the integrated circuit 10. If the inspection switch 62 is turned ON, then the control logic circuit 25 will output to the multiplexer 30 a selection control signal of a high speed clock CLK2. Consequently, the multiplexer 30 selects the high speed clock CLK2 from the clock generating circuit 28, and supplies, via the control logic circuit 25, the high speed clock CLK2 to the MPU 14 and the voltage booster circuit 20. As opposed to the normal operation with the low speed clock CLK1, it is possible, at the time of an inspection, to select a high speed operation that enables inspection of the operation of the MPU 14 and the voltage booster circuit 20 in a short period of time.

The control logic circuit 25 provided in the integrated circuit 10 controls supply and stop of clock signals to the MPU 14 and the voltage booster circuit 20. In the present embodiment, in a light emission cycle where T0=10 seconds, the control logic circuit 25 first supplies a clock signal to the voltage booster circuit 20 during a period of a voltage boost set time T1, in a state where clock signal supply to the MPU 14 is stopped. The voltage booster circuit 20 is operated during the time T1 with this clock signal supply, and the boosted voltage retention capacitor 42 is sequentially charged with a boosted voltage required for light emission.

After completing the voltage boosting operation during the voltage boost set time T1, the control logic circuit 25 stops clock signal supply to the voltage booster circuit 20, and switches to clock signal supply to the MPU 14. Thereby, the MPU 14 is operated to execute: a light emission control of the LED 46 by the light emission control section 18; a processing in which a signal of the diffused light thereof that is received on the photodiode 48 and is then received-light amplified, is converted in the AD conversion circuit 22 into received light data to be read in; and a processing in which the received light data is compared with a fire hazard level in the fire hazard monitoring control section 16 to thereby detect the presence of a fire hazard.

After completing the processing by the light emission control section 18 and the fire hazard monitoring control section 16, the MPU 14 outputs a control signal to the control logic circuit 25. Then, while maintaining clock signal supply to the voltage booster circuit 20 in a stop state, clock signal supply to the MPU 14 is also stopped, and it enters the sleep mode where clock signal supply to the MPU 14 and the voltage booster circuit 20 is stopped.

This sleep mode is continued during the period of a sleep set time T2 while being timer-monitored. When the sleep set time T2 has elapsed, the control logic circuit 25 starts clock signal supply to the voltage booster circuit and a processing of the next light emission driving cycle is started, and the above process is repeated.

Figure 2:
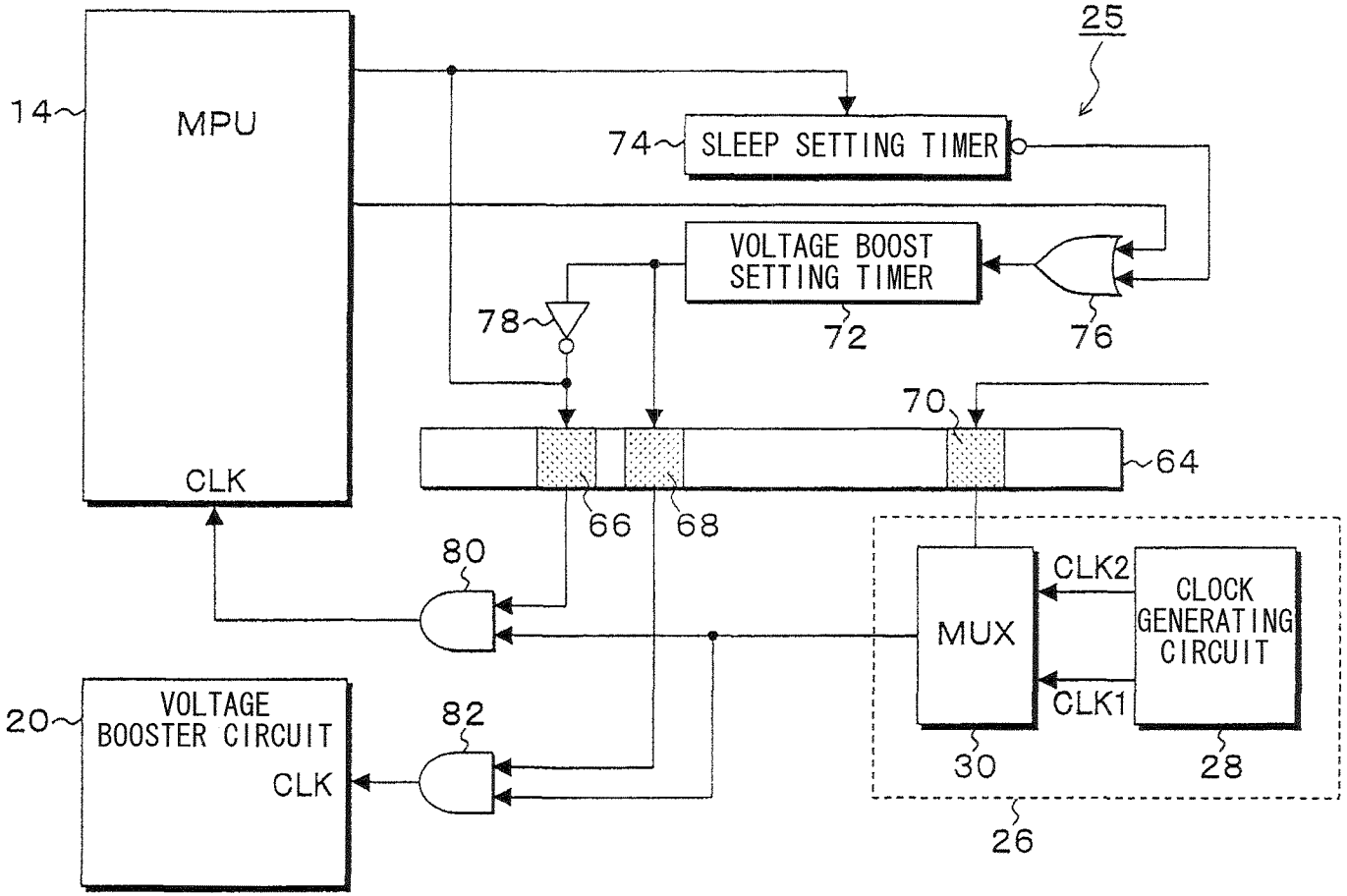
FIG. 2 is a circuit block diagram showing a control logic circuit provided in an integrated circuit according to the same embodiment.

FIG. 2 is a block diagram showing details of the control logic circuit 25 in the present embodiment, along with the MPU 14, the voltage booster circuit 20, the clock generating circuit 28, and the multiplexer 30.

As shown in the diagram, the control logic circuit 25 is provided with a control register 64, a voltage boost setting timer 72, a sleep setting timer 74, an OR gate 76, an inverter 78, an AND gate 80 that functions as a first gate switch, and an AND gate 82 that functions as a second gate switch.

The control register 64 is, for example, an 8 bit register, and an MPU clock control bit 66, a voltage boost clock control bit 68, and a clock selection bit 70 are assigned to arbitrary three bits thereamong.

The MPU clock control bit 66 and the voltage boost clock control bit 68 of the control register 64 controls bit set and bit reset in the circuit section configured with the voltage boost setting timer 72, the sleep setting timer 74, the OR gate 76, and the inverter 78.

For the voltage boost setting timer 72, the voltage boost set time T1 is set that is required for a voltage boost operation of the voltage booster circuit 20. Moreover, for the sleep setting timer 74, the sleep set time T2 is set. In the present embodiment, light emission driving is intermittently performed at a constant cycle T0=10 seconds, and consequently, the voltage boost set time T1 of the voltage boost setting timer 72 is set to approximately 300 milliseconds for example. Moreover, the sleep set time T2 of the sleep setting timer 74 is set to T2=approximately 9.6 seconds for example. Therefore, approximately 100 milliseconds are assigned to the operating time of the MPU 14. Naturally, the operating time of the MPU 14 varies within a certain range, depending on the state of processing at the time, and it does not depend on controls based on timer settings.

The CPU clock control bit 66 of the control register 64, when set to bit 1, brings the AND gate 80 to an allowing state, and supplies the clock signal selected in the multiplexer 30 to the MPU 14 to thereby operate it.

Moreover, also the voltage boost clock control bit 68 of the control register 64, when set to bit 1, brings the AND gate 82 to an allowing state, and supplies the clock signal from the multiplexer 30 to the voltage booster circuit 20, thereby causing it to perform a voltage boosting operation.

Figure 3:
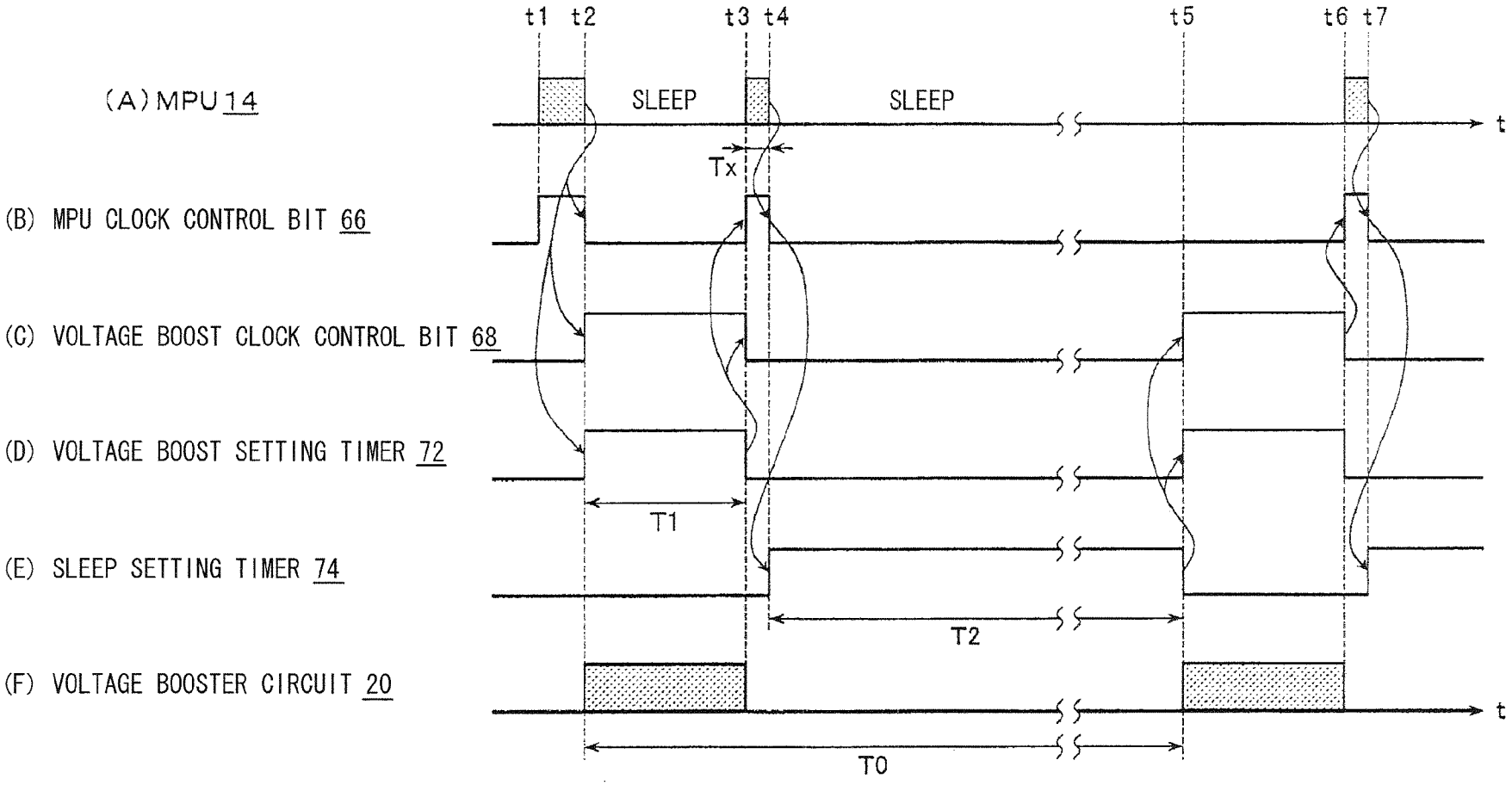
FIG. 3 is a time chart showing a fire hazard monitoring control in the same embodiment.

FIG. 3 is a time chart showing operations of the MPU 14 and the voltage booster circuit 20 based on clock signal supply/stop by the control logic circuit 25 shown in FIG. 2. That is to say, (A) of FIG. 3 shows an operation of the MPU 14, (B) of FIG. 3 shows the MPU clock control bit 66 of the control register 64, and (C) of FIG. 3 shows the voltage boost clock control bit 68 of the control register 64. Moreover, (D) of FIG. 3 shows an operation of the voltage boost setting timer 72, (E) of FIG. 3 shows an operation of the sleep setting timer 74, and (F) of FIG. 3 shows an operation of the voltage booster circuit 20.

In FIG. 3, at first, electric power is supplied to the MPU 14 at time t1. In actuality, this power supply is performed when the battery 38 is housed in the home use alarm unit and a connector is connected thereto.

When the MPU 14 is operated at time t1 by power supply, the MPU clock control bit 66 of the control register 64 brings the AND gate 80 to an allowing state upon reception of a bit 1 set inverted from a bit 0 of the voltage boost setting timer 72 at the time by the inverter 78, and in a normal operation, the low speed clock CLK1 to be output from the clock generating circuit 28 is selected in the multiplexer 30 and supplied to the MPU 14 to thereby operate it. With these operations of the MPU 14 during a period of time between times t1 and t2, an initial diagnosis and an initial setting are performed, and the MPU is brought to an operating state.

At time t2, after completing a self diagnosis and an initial setting upon power-on, the MPU 14 outputs a set signal to the voltage boost setting timer 72 via the OR gate 76 to thereby activate the voltage boost setting timer 72.

When this voltage boost setting timer 72 has been activated by the MPU 14, the timer output rises from the current level 0 to level 1. Upon the inversion of the inverter 78, the MPU clock control bit 66 is reset from the current bit 1 to bit 0, and the voltage boost clock control bit 68 is set from the current bit 0 to bit 1.

Therefore, the AND gate 80 is brought to a disallowing state to thereby stop clock signal supply to the MPU 14, and at the same time, the AND gate 82 is brought to an allowing state to thereby start clock signal supply to the voltage booster circuit 20.

After receiving the clock signal supply, the voltage booster circuit 20 receives an input of a reference voltage output from the reference voltage circuit 24 shown in FIG. 1 as a power supply voltage, and with a charge transferring operation that uses the externally connected capacitor 34, it sequentially charges a boosted voltage to the boosted voltage retention capacitor 42 to thereby generate a boosted voltage, which is, for example, a twofold voltage of the reference voltage.

At time t3 where the voltage boost setting timer 72 has reached the voltage boost set time T1 and the time is up, the output of the voltage boost setting timer 72 is lowered from the current level 1 to level 0, and the MPU clock control bit 66 is set to bit 1 via the inverter 78 while reversely the voltage boost clock control bit 68 is reset to bit 0.

Consequently, the AND gate 82 is brought to a disallowing state to thereby stop clock signal supply to the voltage booster circuit 20 and stop the voltage boosting operation, and at the same time, the AND gate 80 is brought to an allowing state to perform clock signal supply to the MPU 14 to thereby operate it.

With this operation of the MPU 14 upon clock signal supply from time t3, the light emission control section 18 turns ON the light emission driving switch 44 for a short period of time in the order of microseconds, and supplies the boosted voltage retained in the boosted voltage retention capacitor 42 to the LED 46, thereby causing it to emit light.

The light emitted from the LED 46 is diffused by particles of smoke flowing into the smoke-detection section and further received on the photodiode 48, and consequently received light electric current is obtained. The MPU 14 at this time temporarily turns ON the light reception synchronization switch 32 in synchronization with light emission drive to thereby supply electric power to the received light amplifying circuit 50, causing it to operate. Consequently, the received light amplifying circuit 50 amplifies and outputs a received light signal of the photodiode 48, an input of the received light signal is received on the AD conversion circuit 22 to be converted into received light data, and it is read into the MPU 14.

The fire hazard monitoring control section 16 of the MPU 14 compares the received light data read from the AD conversion circuit 22 with a predetermined fire hazard level, and if it is less than or equal to the fire hazard level, then the processing sequence will be finished. At time t4 in FIG. 3, the MPU clock control bit 66 of the control register 64 provided in the control logic circuit 25 is reset from bit 1 to bit 0, and at the same time, the sleep setting timer 74 is reset and started.

Thereby, the MPU clock control bit 66 and the voltage boost clock control bit 68 of the control register 64 are both set to bit 0, bringing the AND gates 80 and 82 to a disallowing state, and it enters a sleep state where clock signal supply to both of the MPU 14 and the voltage booster circuit 20 is stopped.

Subsequently, at time t5, the sleep setting timer 74 has reached the sleep set time T2, time is up, and the timer output is changed from the level 1 to level 0. Since this is an inverted output, level 1 is applied to the voltage setting timer 72 via the OR gate 76 and it is reset and started at time t5.

When the voltage boost setting timer 72 has been reset and started, the voltage boost clock control bit 68 is set to bit 1, and the AND gate 82 is consequently brought into an allowing state. Then clock signal supply is performed to the voltage booster circuit 20 to thereby perform a voltage boosting operation during a period of the voltage boost set time T1 again.

When the time T1 has elapsed and the time is up in the voltage boost setting timer 72, the voltage boost clock control bit 68 is reset to bit 0 at time t6, and at the same time, the MPU clock control bit 66 is set to bit 1. As a result, clock signal supply of the AND gate 82 to the voltage booster circuit 20 is stopped, and at the same time, clock signal supply of the AND gate 82 to the MPU 14 is started. During a period of time between times t6 and t7, processing operations are performed by the MPU 14 serving as the light emission control section 18 and the fire hazard monitoring control section 16 in FIG. 1, and subsequently these are repeated in each predetermined cycle T0.

Figure 4:
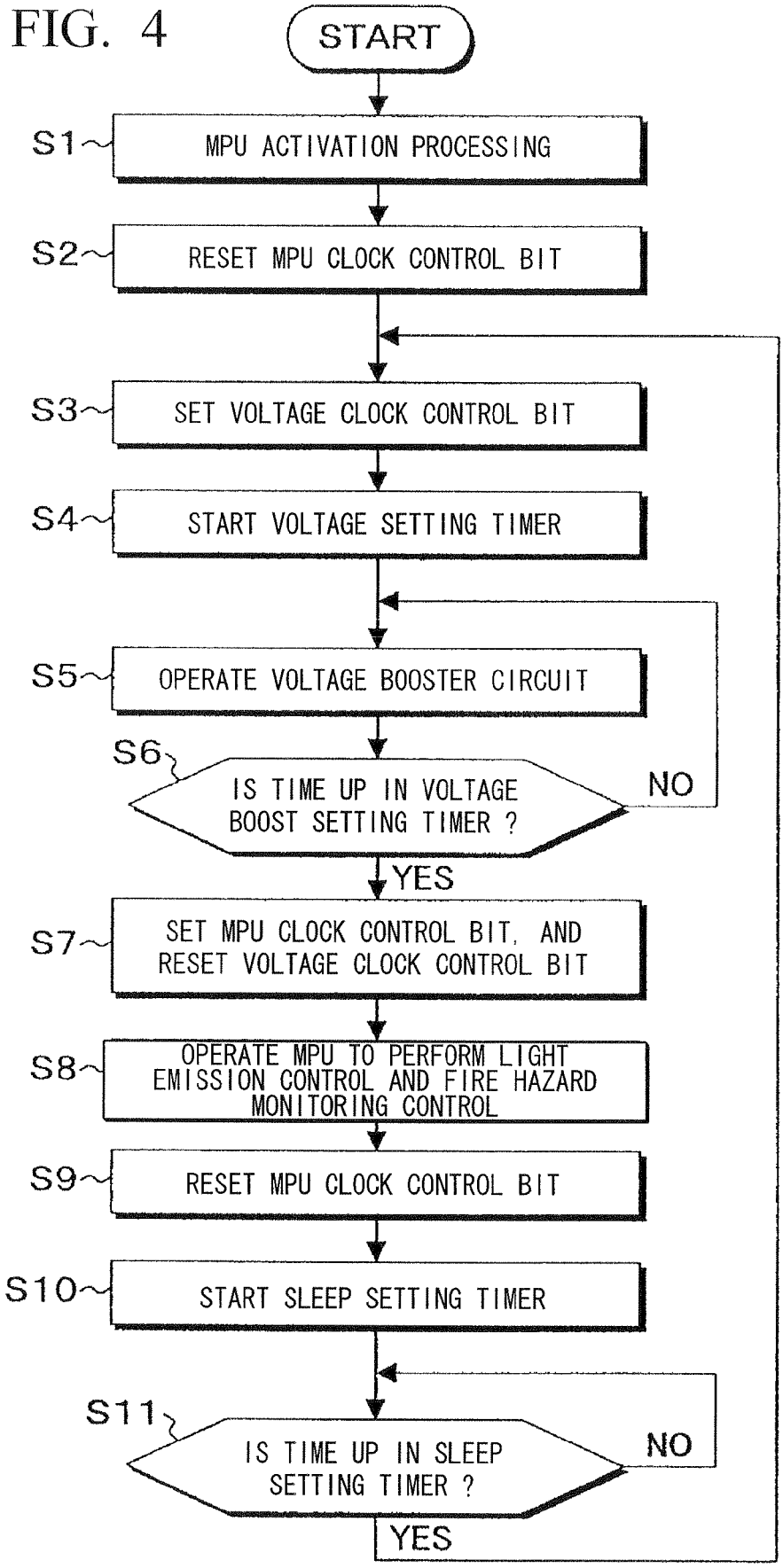
FIG. 4 is a flow chart of the same fire hazard monitoring control.
Figure 5:
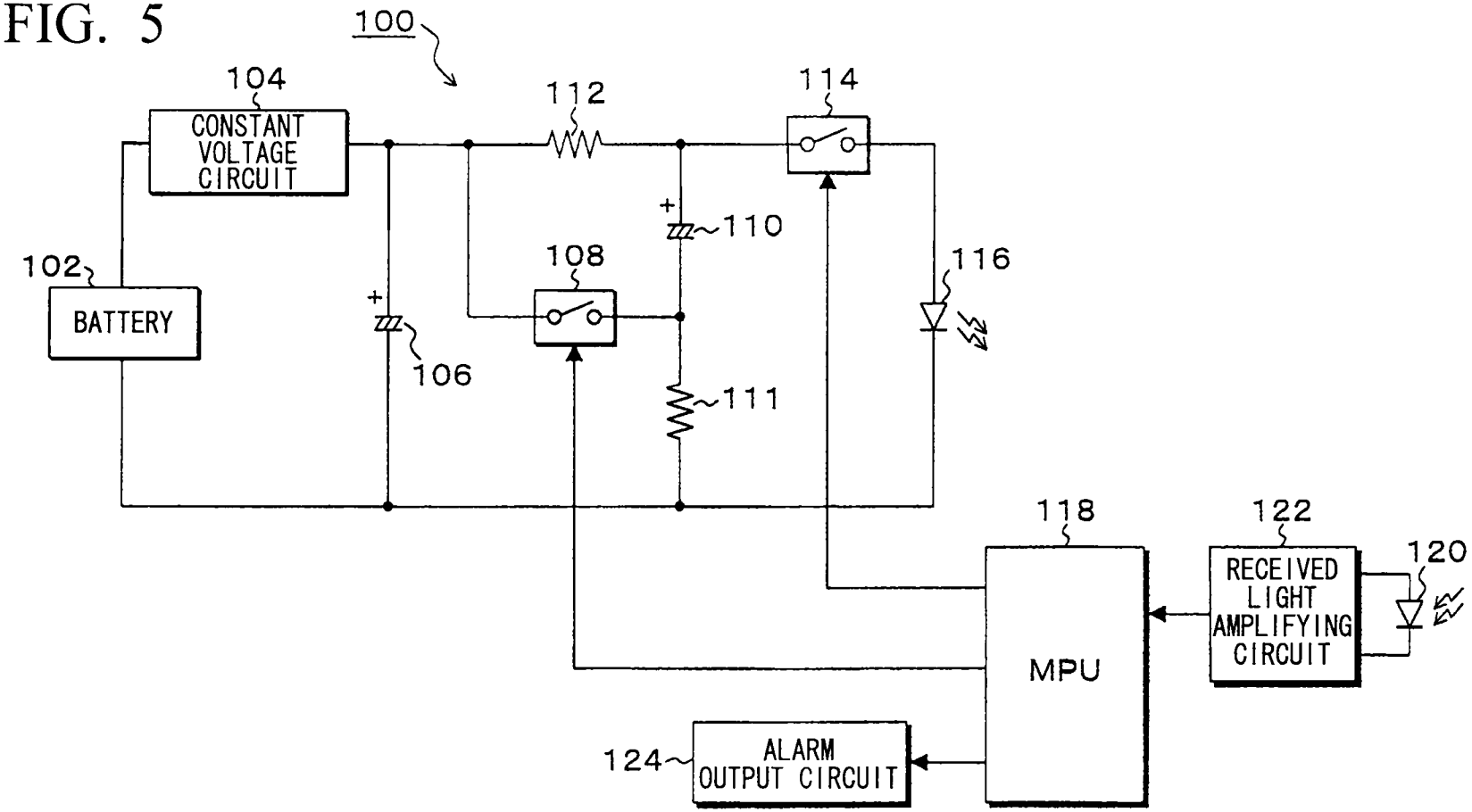
FIG. 5 is a circuit block diagram showing a conventional alarm unit provided with a conventional constant voltage circuit and a conventional light emission driving circuit.
Figure 6:
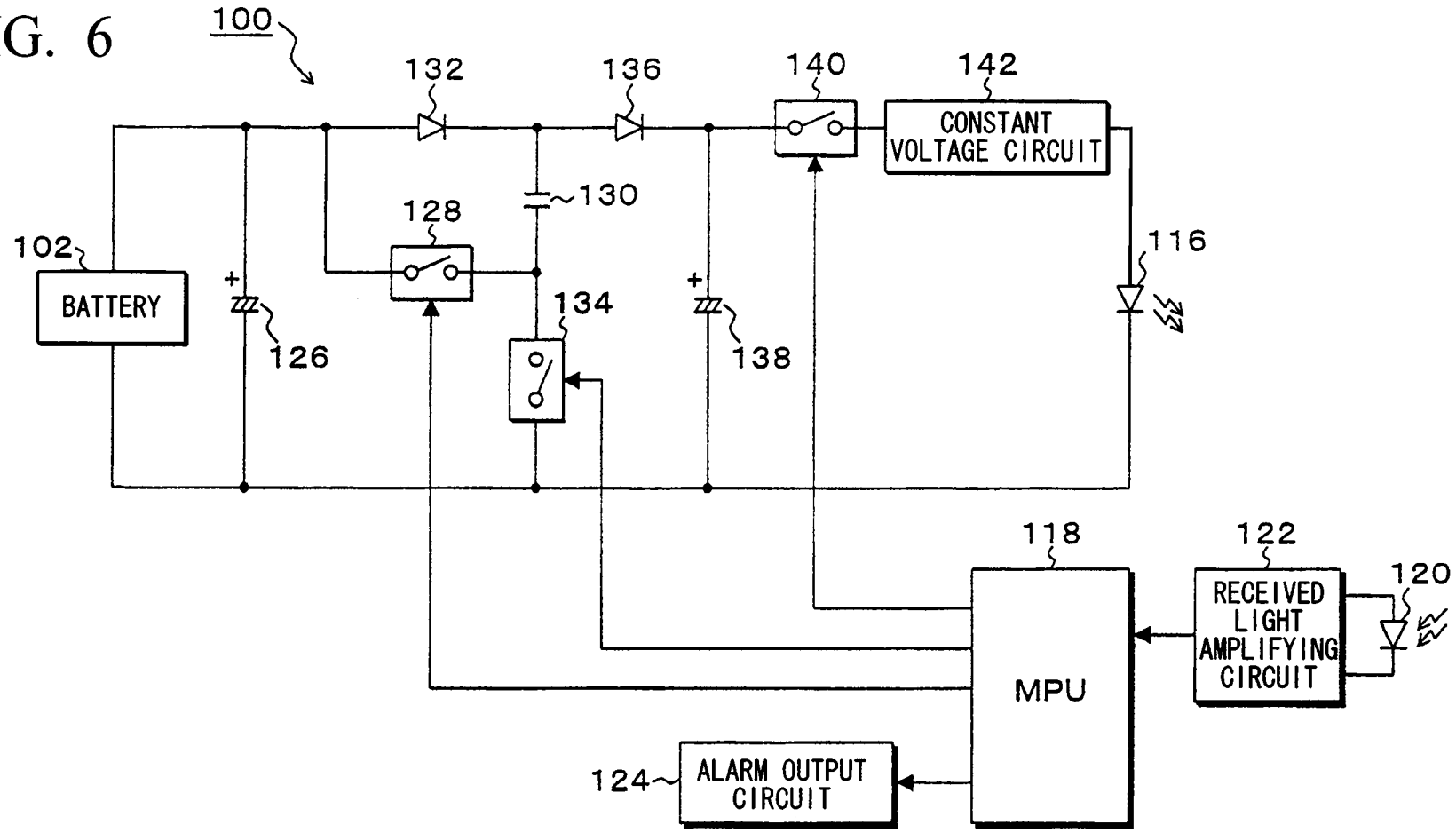
FIG. 6 PRIOR ART
FIG. 6 is a circuit block diagram showing a conventional alarm unit that boosts voltage by repeatedly charging a small capacity capacitor.

FIG. 4 is a flow chart showing a fire hazard monitoring control in the present embodiment, and hereunder is a description thereof also with reference to FIG. 2.

In FIG. 4, upon power-on, that is to say, when electric power is supplied from the battery 38 being set, an MPU activation processing is executed in step S1.

Subsequently, in step S2, the MPU 14 resets the MPU clock control bit 66 of the control register 64 to bit 0, and at the same time, the voltage boost clock control bit 68 is set to bit 1 in step S3. Furthermore, in step S4, the voltage boost setting timer 72 is reset and restarted.

Consequently, in step S5, clock signal supply from the AND gate 80 to the MPU 14 is stopped, and at the same time, clock signal supply from the AND gate 82 to the voltage booster circuit 20 is started, thereby causing the voltage booster circuit 20 to perform a voltage boosting operation.

Subsequently, in step S6, time-up in the voltage boost setting timer 72 is monitored, and when the voltage boost set time T1 has elapsed and the time is up, the processing proceeds to step S7. In step S7, the MPU clock control bit 66 is set to bit 1, and at the same time, the voltage boost clock control bit 68 is reset to bit 0.

As a result, in step S8, the MPU 14 operates to perform light emission control and fire hazard monitoring control. When the processing of the MPU 14 is completed in step S8, in step S9, the MPU clock control bit 66 is reset to bit 0, and consequently, clock signal supply from the AND gate 80 to the MPU 14 is stopped.

At the same time, in step S10, the sleep setting timer 74 is reset and restarted. Consequently, clock signal supply to the MPU 14 and the voltage booster circuit 20 is stopped during a period of the set time T2 of the sleep setting timer, and it is brought into a sleep state where electric power consumption is suppressed.

Subsequently, if time-up of the sleep setting timer 72 is determined in step S11, the processing returns again to step S3, and the voltage boost clock control bit 68 is set to bit 1 to thereby repeat the same processing from the voltage boosting operation of the voltage booster circuit 20.

To describe again with reference to FIG. 1, in an inspection step of a manufacturing stage at a factory, by externally connecting the inspection switch 62 to the integrated circuit 10 and turning it ON, the MPU 14 and the voltage booster circuit 20 can be operated on the high speed clock CLK2.

That is to say, in the control logic circuit 25 in FIG. 2, if the inspection switch 62 in FIG. 1 is turned ON, then the clock selection bit 70 of the control register 64 will be set to bit 1, for example. If it is set to bit 1, the multiplexer 30 will select and output the high speed clock CLK2 among the high speed clock CLK2 and the low speed clock CLK1 output from the clock generating circuit 28.

Consequently, in a case where the alarm unit of the present embodiment is operated in the inspection step, the high speed clock CLK2 selected in the multiplexer 30 is supplied to the voltage booster circuit 20 and the MPU 14. As a result, the predetermined cycle T0=10 seconds shown in the time chart of FIG. 3 is switched to a shorter cycle due to supply of the high speed clock CLK2, and the voltage boosting operation, and the operations of light emission drive and fire hazard monitoring are repeatedly performed in a shorter cycle.

The operation time in this case is in a short cycle according to a constant multiple of the high speed clock CLK2 with respect to the low speed clock CLK1, and each item of various types of inspection items performed in the inspection step can be executed in a short period of time to thereby obtain an inspection result.

When the inspection step is completed, the inspection switch 62 shown in FIG. 1 is detached from its external connection and becomes open. If the inspection switch 62 is detached and becomes open, then the clock selection bit 70 of the control register 64 in FIG. 2 will be fixed to bit 0 for example. Thus, the multiplexer 30 is brought to a normal clock signal selection state where it outputs the low speed clock CLK1 of the clock generating circuit 28.

In the above embodiment, the reference voltage circuit 24 provided in the integrated circuit 10 in FIG. 1 internally generates a reference voltage. However, this reference voltage may be generated by selectively inputting an external set voltage from outside with register control.

Moreover, the control logic circuit 25 illustrated in the above embodiment is an example, and it may be configured with an appropriate logic circuit that realizes the same functions. Furthermore, it is not limited to a logic circuit, and it may be realized as functions to be performed by executing a firmware (control program).

Moreover, the present invention is not limited to the above embodiment, and appropriate modifications may be made thereto without departing from the purpose and advantages of the invention. Furthermore, the present invention is not limited only to the numerical values illustrated in the above embodiment.

INDUSTRIAL APPLICABILITY

According to an alarm unit of the present invention, it is possible to further reduce electric current consumption even where voltage boost light emission is required, thereby extending battery life, while is possible to reduce the number of components and the cost.

The invention claimed is:

1. An alarm unit comprising:

a light emitting section;

a battery power supply;

a voltage booster circuit that boosts a voltage from the battery power supply to thereby generate a boosted voltage;

a control circuit that sets an operating time of the voltage booster circuit;

a light emission control section that selectively couples the boosted voltage to the light emitting section based on the operating time of the voltage booster circuit ending, thereby intermittently driving light emission;

a light receiving section that outputs a received light signal based on receiving light from the light emitting section, the received light having been diffused by smoke;

a conversion circuit that converts the received light signal from the light receiving section into received light data;

a fire hazard detection section that detects a fire hazard based on the received light data from the conversion circuit and outputs a fire hazard detection signal based thereon;

an alarm section that outputs an alarm based on the fire hazard detection signal from the fire hazard detection section;

a reference voltage circuit that generates a reference voltage for the voltage booster circuit and the conversion circuit;

a processor circuit that realizes functions of the light emission control section and the fire hazard detection section by executing a program; and a clock circuit that outputs a clock signal for operating the voltage booster circuit, the processor circuit, and the conversion circuit, wherein the processor circuit, the voltage booster circuit, the conversion circuit, the reference voltage circuit, the clock circuit, and the control circuit of the respective circuit sections are provided on a packaged integrated circuit, and wherein the control circuit switches between a state in which a supply of the clock signal to the processor circuit is stopped and the clock signal is supplied to the booster circuit, a state in which the supply of the clock signal to the booster circuit is stopped and the clock signal is supplied to the processor circuit, and a state in which the supply of the clock signal is to the booster circuit and the processor circuit.

2. The alarm unit according to claim 1, wherein the alarm unit includes a test mode and a non-test mode, and the clock circuit includes:

a clock generating circuit that outputs a low speed clock signal and a high speed clock signal;

a switching device that selects between the low speed clock signal and the high speed clock signal; and the control circuit includes a section that switches the switching device to selectively output the high speed clock signal if the test mode is set, and to selectively output the low speed clock signal if the non-test mode is set.

3. An alarm unit comprising:

a light emitting section;

a battery power supply;

a voltage booster circuit that boosts a voltage from the battery power supply to thereby generate a boosted voltage;

a control circuit that sets an operating time of the voltage booster circuit;

a light emission control section that selectively couples the boosted voltage to the light emitting section based on the operating time of the voltage booster circuit ending, thereby intermittently driving light emission;

a light receiving section that outputs a received light signal based on receiving light from the light emitting section, the received light having been diffused by smoke;

a conversion circuit that converts the received light signal from the light receiving section into received light data;

a fire hazard detection section that detects a fire hazard based on the received light data from the conversion circuit and outputs a fire hazard detection signal based thereon;

an alarm section that outputs an alarm based on the fire hazard detection signal from the fire hazard detection section;

a reference voltage circuit that generates a reference voltage for the voltage booster circuit and the conversion circuit;

a processor circuit that realizes functions of the light emission control section and the fire hazard detection section by executing a program; and a clock circuit that outputs a clock signal for operating the voltage booster circuit, the processor circuit, and the conversion circuit, wherein the control circuit includes:

a first switching section that turns ON or OFF a clock signal supplied from the clock circuit to the processor circuit;

a second switching section that turns ON or OFF the clock signal supplied from the clock circuit section to the voltage booster circuit;

a voltage boost setting timer that sets the operating time of the voltage booster circuit;

a sleep setting timer that sets a sleep time of the alarm unit;

a voltage boost control section that, in response to a state where the sleep setting timer is inactive and the first switching section is turned OFF, turns ON the second switching section to supply the clock signal to the voltage booster circuit to thereby operate the voltage booster circuit and activates the voltage boost setting timer to monitor the elapse of the voltage boost set time;

a processor control section that, in response to the second switching section being turned OFF based on the voltage boost setting timer elapsing, turns ON the first switching section to supply the clock signal to the processor circuit to thereby operate the processor circuit; and a sleep control section that activates the sleep setting timer and turns OFF the first switching section to stop the supply of the clock signal when the operation of the processor circuit is finished, and that monitors the elapse of the sleep set time, and de-activates the sleep setting timer to activate the voltage boost control section when the sleep set time has elapsed, and wherein the processor circuit, the voltage booster circuit, the conversion circuit, the reference voltage circuit, the clock circuit, and the control circuit of the respective circuit sections are provided on a packaged integrated circuit.

4. The alarm unit according to claim 3, wherein the control circuit has a control register provided with a first control bit and a second control bit corresponding to the first switching section and the second switching section, and turns ON or OFF the first switching section and the second switching section to thereby control supply and stop of the clock signal, according to a bit set and a bit reset with respect to the first control bit and the second control bit.

5. The alarm unit according to claim 1, wherein the voltage booster receives an input of the reference voltage output from the reference voltage circuit to thereby generate a substantially twofold boosted voltage.

* * * * *